United States Patent [19]

Chern

[11] Patent Number: 4,899,559

[45] Date of Patent: Feb. 13, 1990

[54] HANGING LOCK

[76] Inventor: Jenn-Rong Chern, 113 Pirng-deeng Rd., Diing-Tsuoh Lii, Luh-Gaang Jehn, Jang-Huah Hsien, Taiwan

[21] Appl. No.: 278,255

[22] Filed: Nov. 30, 1988

[51] Int. Cl.[4] ..... E05B 37/14

[52] U.S. Cl. ..... 70/25; 70/312

[58] Field of Search ..... 70/25, 26, 20, 22, 24, 70/312

[56] References Cited

U.S. PATENT DOCUMENTS

| | | | |
|---|---|---|---|
| 1,940,789 | 12/1933 | Diaz | 70/25 |
| 3,633,393 | 1/1972 | Hisatsune | 70/25 |
| 4,476,698 | 10/1984 | Trespo | 70/25 |

FOREIGN PATENT DOCUMENTS

| | | | |
|---|---|---|---|
| 68875 | 4/1949 | Denmark | 70/25 |
| 240746 | 5/1946 | Switzerland | 70/25 |

*Primary Examiner*—Robert L. Wolfe

*Attorney, Agent, or Firm*—Bucknam and Archer

[57] ABSTRACT

The hanging lock is opened and closed by adjusting numbers. It comprises a U-shaped locking rod (10), having a stop (11), a slide plate (40), an upper cover (30), and a lower plate (20). The slide plate is located between the upper cover and the lower cover. Two dials (53, 54) are provided and a reed (55). The lower cover (20) has two semicircular grooves (21, 22) for insertion of the locking rod when the device is assembled. A spring (50) is disposed at the end of the longer arm of the locking rod (10) and a pair of posts are located on the lower cover. A slide rail (27) disposed between the posts has a concave portion for fitting a spring. The slide rail protrudes at one end of the form a flange (24) and is capable of moving backward and forward to open and close the locking device. The dials (53, 54) are placed on top of circular holes on the slide plate. Number cases (60) are installed on the top of each of the circular holes of the slide plate to get up with the number dial by means of the convex block.

1 Claim, 2 Drawing Sheets

HANGING LOCK

The present invention relates to hanging locks of the type which are opened and closed by adjustment of preselected numbers.

BACKGROUND OF THE INVENTION

Many different types of locking devices are known. The manufacturers have developed many types of hanging locks with numbers which are opened and closed by adjustment of preselected numbers. Although these structures present some novel and advantageous features, they still have drawbacks, such as complicated structures, high manufacturing cost, difficulties in the release of the locking rod on the surface of the dial, damage of the component parts. Further, they are devoid of a spring to facilitate the release of the locking rod, and it has been necessary to pull the locking rod totally manually.

The present invention provides a novel locking device which overcomes the drawbacks of the known devices.

The crux of the present invention resides in the incorporation of springs into the locking device and to drive a slide plate by matching on the dials and the inner snare to control the tongue to perform the action of closing and opening.

The invention is illustrated by the accompanying drawings of which:

Figure 2:
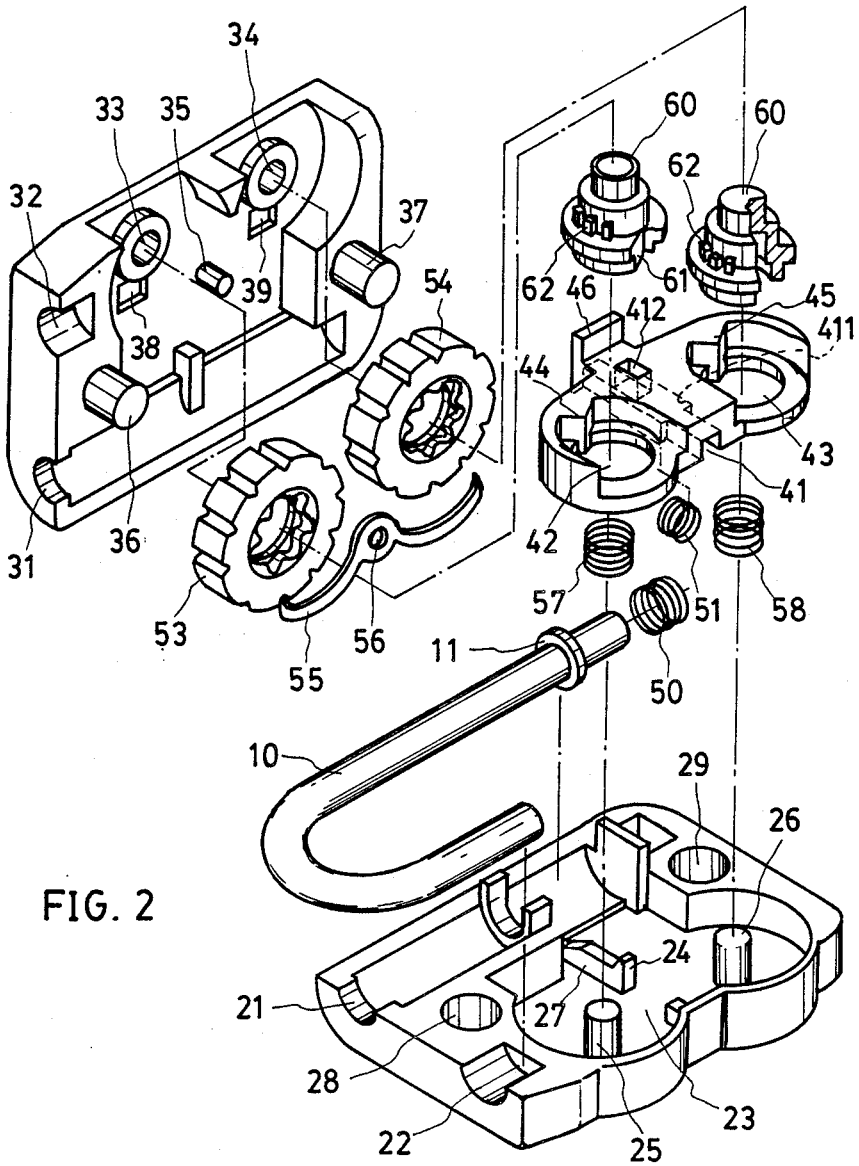
FIG. 2 is an exploded view of the component parts of the locking device.

As shown in FIG. 2, the device comprises the following components: two dials 53, 54 on which the numbers are located, an upper cover 30, a lower cover 20, a locking rod 10, a sliding plate 40, and springs 57, 58, 50 and 51. The device also comprises inner gear blocks 60 and a reed 55.

Figure 1:
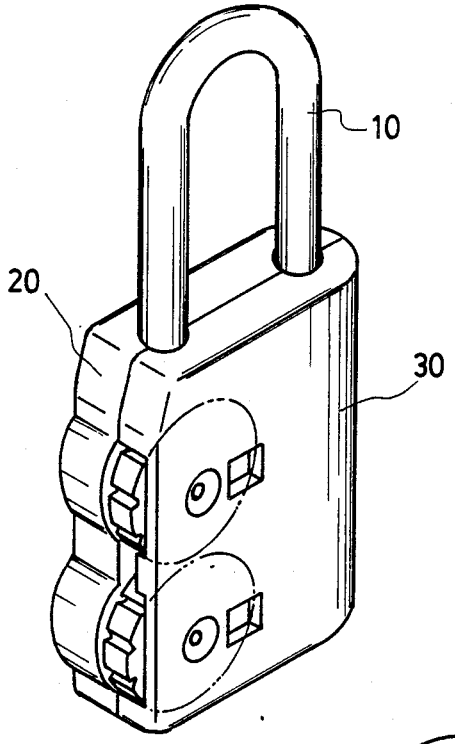
FIG. 1 is a perspective view of the assembled hanging locking device.

As shown in FIG. 1, the dials 53 and 54 which have the numbers on them are located on one side of the device. The locking rod 10 is U-shaped and is provided with a ring 11 close to the end of the longer arm of the U-shaped locking rod. This ring acts as a stop.

The lower cover 20 is provided with semi-circular grooves 21, 22 which are intended to engage with the two ends of the locking rod. Spring 50 is inserted at the bottom of the longer groove 21. The lower cover is also provided with two supporting posts 25, 26 for the insertion of the sliding plate 411.

Springs 57, 58 are each located below the dials 53, 54 to support the number wheels. Convex slide rail 27 is disposed horizontally about in the middle of the lower cover. The slide rail 27 is cut in the middle for the installation of a spring 51. A flange 24 is provided at one end as the fixing point of the braking spring 51. The slide rail 27 is used as the guide rail of the linear motion of the slide plate 411. Two fixing holes 42, 43 are located in the slide plate 411.

The upper cover 30 is provided with two circular grooves 31, 32 in position corresponding to the grooves 21, 22 to form a full circle in which the locking rod is inserted. Two circular holes 33, 34 are provided in position corresponding to the two posts 25, 26. Post 35 is located in front of the two circular holes for engaging with the central hole 56 in the reed 55.

Two fixing axles 36, 37 are disposed in position corresponding to the fixing holes 28, 29 of the lower cover. Square holes 38, 39 are also provided for the display of the numbers on the dials.

When the locking device is assembled, the slide plate 40 is encased on the slide rail 27 of the lower cover 20, by means of slide groove 41 on the bottom of it, and there is a wider groove 411 on the part of the slide plate corresponding to the opening 23 of the lower cover 20 to contain the spring 51. There is a penetrating long groove 412 on the upper end of the wider groove 411 to be used for containing the flange 24 of the slide rail of the lower cover 20. Circular holes 42, 43 are provided on the left and right side of the large openings for engaging the two posts 25, 26 of the lower cover for encasing the number dials.

Each flange 44, 45 extends at the same angle from the circular holes 42, 43 to check the relative concave angles of the number dials when the locking device is opened. Pushing block 46 extends from one end of the slide plate and is used to control the action of the locking rod to open and close the device due to the action of the braking ring 11 and the pushing block 46. The dials are positioned on top of the openings 42, 43 in the slide plate, and the two posts 25, 26 are inserted through the dials to hold them in position. There are special concave angles 61, 61A on the circle, with the largest external diameter and the size and angle of the concave angles are exactly the same as the flanges 44, 45 of the slide block 40. Convex blocks 62 are positioned on the edge of the upper axes and are used for gearing and driving the inner gear blocks 60 of the number dials 53, 54.

Figure 3:
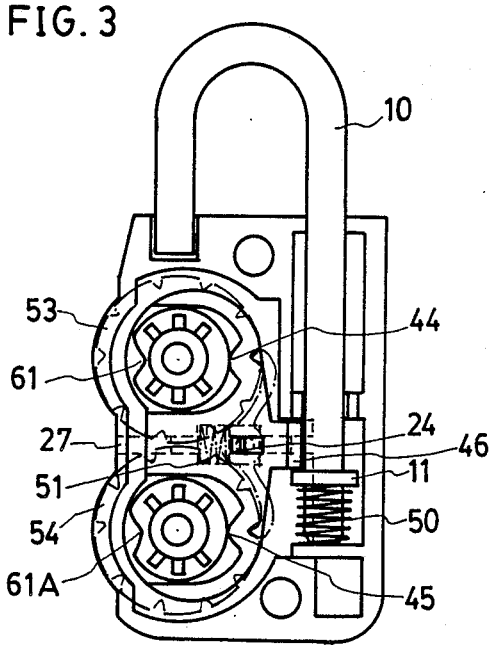
FIG. 3 illustrates the hanging locking device when closed.
Figure 4:
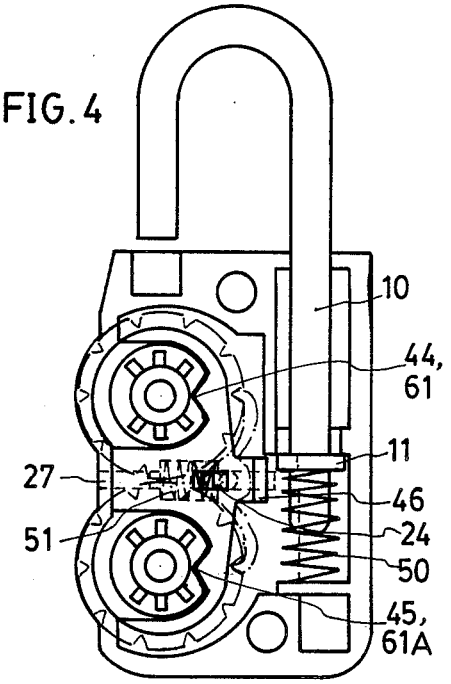
FIG. 4 illustrates the locking device in the open position.

When the locking device is closed, as shown in FIG. 3, the flanges of the slide plate 44, 45 are not geared with the concave angles 61, 61A of the number dial. The slide plate 40 utilizes the slide groove 41 to move forward on the slide rail 27, so the pushing block 46 on the former end of the slide plate 40 moves forward, and the penetrating long hole 412 of the slide plate 40 changed to brake the flange 24 of the lower cover by the latter surface of the hole instead of the former surface of the hole, and the wide groove 411 moves forward to push the spring 51. On account of being blocked by the end surface of the flange 24 of the lower cover 20, the spring 51 is compressed because it is blocked by the end surface of the flange 24 of the lower cover. The pushing block 46 of the forward end of the slide plate blocks the stop 11 of the locking rod, the latter cannot become free, and the inner blocks 60 are inserted into the number dials.

When the dials are turned to the preselected numbers, the flanges 44, 45 of the slide block 411 are geared up with the concave angles 61 of the inner gear block of the number dial exactly. The slide plate is pushed along the slide rail due to the tension of spring 51. The braking ring 11 is released and the locking rod is pushed upwardly under the action of the spring 50.

What is claimed is:

1. A locking device of the type which is opened and closed by adjusting to preselected numbers, which comprises a U-shaped locking rod (10) having one arm longer than the other and having stop (11), a slide plate (40), an upper cover (30), a lower plate (20), said slide plate being located between said upper cover and said lower cover, two dials with numbers (53, 54), located at one side of the device, said lower cover (20) having two semicircular grooves (21, 22), one of said grooves (21) being longer than the other for engagement with the longer arm of said locking rod, a first spring (50) disposed in said groove (21), a pair of posts (25, 26) on said lower cover, a slide guide rail (27) disposed horizontally between said posts, said slide guide rail having a concave portion for fitting a second spring (51), said slide guide rail protruding at one end to form a flange (24), said slide plate (40) being capable of moving backward and forward to open and close the locking device, said upper cover having two semicircular grooves (31, 32) in position to form two cylindrical holes together with said grooves (21, 22) in said lower cover for insertion of said locking rod, two holes (33, 34) in said upper cover for engagement with said posts (25, 26) on said lower cover, a pair of square holes (38, 39) arranged on a tangent of said circular holes for the display of the numbers, a reed (55) having an opening (56) in the center, a post, (35) between said holes (33, 34) for engagement with said opening (56) in said reed, two fixing axles (37, 38) on said upper cover for engagement with two holes (28, 29) on said lower cover, said slide plate (40) having a groove (41) at the bottom thereof for engagement with said slide guide rail, two circular openings (42, 43) and a flange (44, 45) extending from each of said circular openings, said lower plate (20) forming an opening (23), said slide plate (40) forming a groove (411) and a groove (412) in the center of said slide plate for engagement with said flange (24), said flange (44, 45) extending at the same angle from said circular openings at the concave angle (61, 61A), a pushing block (46) at one end of said slide plate for braking the stop (11) of said locking rod, said dials (53, 54) being placed on top of said circular holes (42, 43) on said slide plate, springs (57, 58) located below and supporting said dials two number cases (60) being installed on the top of each of the circular holes of the slide plate, a concave angle (61, 61A) being located on the circumference of each case to match with said flanges (44, 45), said pushing block (46) blocking said stop (11) in the closed position, and when the dials are turned to the preselected numbers, said pg,10 flanges (44, 45) gear with the concave angles (61, 61A) of said cases (60), whereby said slide plate is pushed along said slide guide rail and the stop (11) is released.

* * * * *